US006231749B1

(12) United States Patent
Degnan et al.

(10) Patent No.: US 6,231,749 B1
(45) Date of Patent: May 15, 2001

(54) PRODUCTION OF HIGH VISCOSITY INDEX LUBRICANTS

(75) Inventors: Thomas F. Degnan, Moorestown, NJ (US); Robert T. Hanlon, Glen Mills, PA (US); Grant G. Karsner, Voorhees Township; Dominick N. Mazzone, Wenonah, both of NJ (US)

(73) Assignee: Mobil Oil Corporation, New York, NY (US)

( * ) Notice: Subject to any disclaimer, the term of this patent is extended or adjusted under 35 U.S.C. 154(b) by 0 days.

(21) Appl. No.: 09/439,665

(22) Filed: Nov. 15, 1999

Related U.S. Application Data

(63) Continuation-in-part of application No. 09/079,457, filed on May 15, 1998, now abandoned.

(51) Int. Cl.[7] ..... C10G 73/02

(52) U.S. Cl. ..... 208/27; 208/18; 208/49; 208/58; 208/96; 208/59; 208/97; 208/111.13; 585/739

(58) Field of Search ..... 208/27, 18, 49, 208/58, 96, 59, 97, 111.13; 585/539

(56) References Cited

U.S. PATENT DOCUMENTS 3,365,390 * 1/1968 Egan et al. ..... 208/27
4,975,177 * 12/1990 Garwood et al. ..... 208/27

* cited by examiner

*Primary Examiner*—Helane Myers

(57) ABSTRACT

Petroleum wax feeds are converted to high viscosity index lubricants by a two-step hydrocracking-hydroisomerization process in which the wax feed which exhibits branchingis initially subjected to hydrocracking under mild conditions with a conversion to non-lube range products of no more than about 30 weight percent of the feed. The hydrocracking is carried out at a hydrogen pressure of at least 1000 psig (7000 kPa) using an amorphous catalyst which preferentially removes the aromatic components present in the initial feed. The hydrocracked effluent is then subjected to hydroisomerization in a second step using a low acidity zeolite beta catalyst which effects a preferential isomerization on the paraffin components to less waxy, high VI isoparaffins. The second stage may be operated at high pressure by cascading the first stage product into the second stage or at a lower pressure, typically from 200 to 1000 psig. The second stage catalyst is preferably a noble metal containing zeolite beta catalyst which contains boron as a framework component of the zeolite to give a low alpha value, typically below 10 while maintaining an isomerizaiton selectiveity of no less than 48%. The second stage is carried out at relatively low temperature, typically from 600° to 650° F. with a 650° F.+ conversion in the range of 10 to 20 weight percent of the second stage feed but with high selectivity for isomerization of the paraffins. A final dewaxing step to target pour point may be used with relatively low loss, typically no more than 15 weight percent, during this dewaxing. The final products typically have VI values in excess of 140 and usually in the range of 143 to 147 and are characterized by exceptional stability.

14 Claims, 6 Drawing Sheets

PRODUCTION OF HIGH VISCOSITY INDEX LUBRICANTS

CROSS REFERENCE TO RELATED APPLICATIONS

Figure 1:
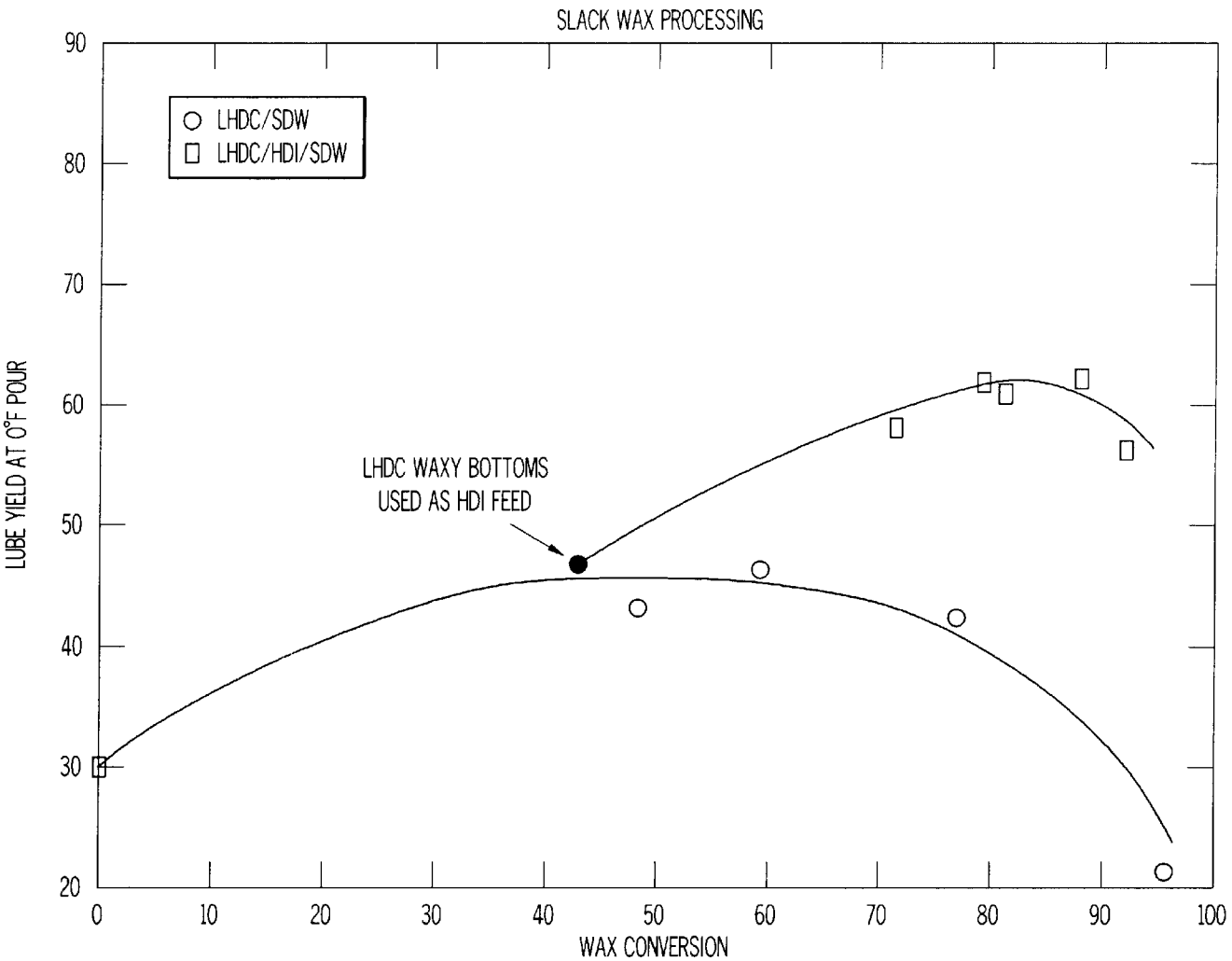

This application is a continuation in-part application of copending application Ser. No. 09/079,457, filed May 15, 1998, entitled "Production of High Viscosity Index Lubricants" now abandoned.

FIELD OF THE INVENTION

This invention relates to the production of high viscosity index lubricants by hydrocracking mineral oil feedstocks, especially petroleum waxes.

BACKGROUND OF THE INVENTION

Mineral oil based lubricants are conventionally produced by a separative sequence carried out in the petroleum refinery which comprises fractionation of a paraffinic crude oil under atmospheric pressure followed by fractionation under vacuum to produce distillate fractions (neutral oils) and a residual fraction which, after deasphalting and severe solvent treatment may also be used as a lubricant basestock usually referred to as bright stock. Neutral oils, after solvent extraction to remove low viscosity index (V.I.) components are conventionally subjected to dewaxing, either by solvent or catalytic dewaxing processes, to the desired pour point, after which the dewaxed lubestock may be hydrofinished to improve stability and remove color bodies. This conventional technique relies upon the selection and use of crude stocks, usually of a paraffinic character, which produce the desired lube fractions of the desired qualities in adequate amounts. The range of permissible crude sources may, however, be extended by the lube hydrocracking process which is capable of utilizing crude stocks of marginal or poor quality, usually with a higher aromatic content than the best paraffinic crudes. The lube hydrocracking process, which is well established in the petroleum refining industry, generally comprises an initial hydrocracking step carried out under high pressure in the presence of a bifunctional catalyst which effects partial saturation and ring opening of the aromatic components which are present in the feed. The hydrocracked product is then subjected to dewaxing in order to reach the target pour point since the products from the initial hydrocracking step which are paraffinic in character include components with a relatively high pour point which need to be removed in the dewaxing step.

Current trends in the design of automotive engines are associated with higher operating temperatures as the efficiency of the engines increases and these higher operating temperatures require successively higher quality lubricants. One of the requirements is for higher viscosity indices (V.I.) in order to reduce the effects of the higher operating temperatures on the viscosity of the engine lubricants. High V.I. values have conventionally been attained by the use of V.I. improvers e.g. polyacrylates, but there is a limit to the degree of improvement which may be effected in this way; in addition, V.I. improvers tend to undergo degradation under the effects of high temperatures and high shear rates encountered in the engine, the more stressing conditions encountered in high efficiency engines result in even faster degradation of oils which employ significant amounts of V.I. improvers. Thus, there is a continuing need for automotive lubricants which are based on fluids of high viscosity index and which are stable to the high temperature, high shear rate conditions encountered in modern engines.

Synthetic lubricants produced by the polymerization of olefins in the presence of certain catalysts have been shown to possess excellent V.I. values, but they are expensive to produce by the conventional synthetic procedures and usually require expensive starting materials. There is therefore a need for the production of high V.I. lubricants from mineral oil stocks which may be produced by techniques comparable to those presently employed in petroleum refineries.

In theory, as well as in practice, lubricants should be highly paraffinic in nature since paraffins possess the desirable combination of low viscosity and high viscosity index. Normal paraffins and slightly branched paraffins e.g. n-methyl paraffins, are waxy materials which confer an unacceptably high pour point on the lube stock and are therefore removed during the dewaxing operations in the conventional refining process described above. It is, however, possible to process waxy feeds in order to retain many of the benefits of their paraffinic character while overcoming the undesirable pour point characteristic. A severe hydrotreating process for manufacturing lube oils of high viscosity index is disclosed in *Developments in Lubrication* PD 19(2), 221–228, S. Bull et al, and in this process, waxy feeds such as waxy distillates, deasphalted oils and slack waxes are subjected to a two-stage hydroprocessing operation in which an initial hydrotreating unit processes the feeds in blocked operation with the first stage operating under higher temperature conditions to effect selective removal of the undesirable aromatic compounds by hydrocracking and hydrogenation. The second stage operates under relatively milder conditions of reduced temperature at which hydrogenation predominates, to adjust the total aromatic content and influence the distribution of aromatic types in the final product. The viscosity and flash point of the base oil are then controlled by topping in a subsequent redistillation step after which the pour point of the final base oil is controlled by dewaxing in a solvent dewaxing (MEK-toluene) unit. The slack waxes removed from the dewaxer may be reprocessed to produce a base oil of high viscosity index.

Processes of this type, employing a waxy feed which is subjected to hydrocracking over an amorphous bifunctional catalyst such as nickel-tungsten on alumina or silica-alumina are disclosed, for example, in British Patents Nos. 1,429,494, 1,429,291 and 1,493,620 and U.S. Pat. Nos. 3,830,273, 3,776,839, 3,794,580, and 3,682,813. In the process described in GB 1,429,494, a slack wax produced by the dewaxing of a waxy feed is subjected to hydrocracking over a bifunctional hydrocracking catalyst at hydrogen pressures of 2,000 psig or higher, followed by dewaxing of the hydrocracked product to obtain the desired pour point. Dewaxing is stated to be preferably carried out by the solvent process with recycle of the separated wax to the hydrocracking step.

In processes of this kind, the hydrocracking catalyst is typically a bifunctional catalyst containing a metal hydrogenation component on an amorphous acidic support. The metal component is usually a combination of base metals, with one metal selected from the iron group (Group VIII) and one metal from Group VIB of the Periodic Table, for example, nickel in combination with molybdenum or tungsten. Modifiers such as phosphorus or boron may be present, as described in GB 1,350,257, GB 1,342,499, GB 1,440,230, FR 2,123,235, FR 2,124,138 and EP 199,394. Boron may also be used as a modifier as described in GB 1,440,230. The activity of the catalyst may be increased by the use of fluorine, either by incorporation into the catalyst during its preparation in the form of a suitable fluorine compound or by in situ fluoriding during the operation of the process, as disclosed in GB 1,390,359.

Although the process using an amorphous catalyst for the treatment of the waxy feeds has shown itself to be capable of producing high V.I. lubricants, it is not without its limitations. At best, the technique requires a significant dewaxing capability, both in order to produce the feed as well as to dewax the hydrocracked product to the desired pour point. The reason for this is that although the amorphous catalysts are effective for the saturation of the aromatics under the high pressure conditions which are typically used (about 2,000 psig) their activity and selectivity for isomerization of the paraffinic components is not as high as might be desired; the relatively straight chain paraffins are not, therefore, isomerized to the less waxy isoparaffins of relatively high viscosity index but with low pour point properties, to the extent required to fully meet product pour point specifications. The waxy paraffins which pass through the unit therefore need to be removed during the subsequent dewaxing step and recycled, thus reducing the capacity of the unit. The restricted isomerization activity of the amorphous catalysts also limits the single-pass yields to a value below about 50 percent, with the corresponding wax conversion being about 30 to 60%, even though higher yields would obviously enhance the efficiency of the process. The product VI is also limited by the isomerization activity, typically to about 145 at 0° F. pour point in single pass operation. The temperature requirement of the amorphous catalysts is also relatively high, at least in comparison to zeolite catalysts, typically being about 700°–800° F.

Another approach to the upgrading of waxy feeds to high V.I. lubricant basestocks is disclosed in U.S. Pat. Nos. 4,919,788 and 4,975,177 (Ser. No. 07/382,077). In this process, a waxy feed, typically a waxy gas oil, a slack wax, or a deoiled wax, is hydroprocessed over a highly siliceous zeolite beta catalyst. Zeolite beta is known to be highly effective for the isomerization of paraffins in the presence of aromatics, as reported in U.S. Pat. No. 4,419,220, and its capabilities are effectively exploited in the process of U.S. Pat. No. 4,919,788 and 4,975,177 (Ser. No. 07/382,077) in a manner which optimizes the yield and viscometric properties of the products. The zeolite beta catalyst isomerizes the high molecular weight paraffins contained in the back end of the feed to less waxy materials while minimizing cracking of these components to materials boiling outside the lube range. The waxy paraffins in the front end of the feed are removed in a subsequent dewaxing step, either solvent or catalytic, in order to achieve the target pour point. The combination of paraffin hydroisomerization with the subsequent selective dewaxing process on the front end of the feed is capable of achieving higher product V.I. values than either process on its own and, in addition, the process may be optimized either for yield efficiency or for V.I. efficiency, depending upon requirements.

While this zeolite-catalyzed process has shown itself to be highly effective for dealing with highly paraffinic feeds, the high isomerization selectivity of the zeolite beta catalysts, coupled with its lesser capability to remove low quality aromatic components, has tended to limit the application of the process to feeds which contain relatively low quantities of aromatics: the aromatics as well as other polycyclic materials are less readily attacked by the zeolite with the result that they pass through the process and remain in the product with a consequent reduction in V.I. The lube yield also tends to be constrained by the low wax isomerisation selectivity at low conversions and by wax cracking out of the lube boiling range at high conversions: maximum lube yields are typically obtained in the 20 to 30 weight percent conversion range (650° F.+ conversion). It would therefore be desirable to increase isomerization selectivity and simultaneously to reduce hydrocracking selectivity in order to improve lube yield while retaining the high VI numbers in the product.

U.S. Pat. No. 3,365,390 discloses a process for hydrocracking a heavy oil feed, then isomerizing the wax found in the hydrocracked effluent. Hydrocracked wax (column 3, line 3–8) differs substantially from wax separated by conventional solvent dewaxing of straight run lubricating oil fractions. In particular, the hydrocracked wax of Egan, which is produced from hydrocracking a heavy oil feed, is stated to be of the microcrystalline type which includes a larger proportion of isoparaffins to normal paraffins as compared to straight run wax.

The preferred heavy oil feed of Egan to the hydrocracking step (column 3, line 65–68) is a straight run vacuum gas oil or a feed of comparable boiling range. The single most preferred feed is a deasphalted residual oil.

In summary, therefore, the processes using amorphous catalysts can be regarded as inferior in terms of single pass conversion and overall yield because the amorphous catalysts are relatively non-selective for paraffin isomerization in the presence of polycyclic components but have a high activity for cracking so that overall yield remains low and dewaxing demands are high. The zeolite-catalyzed process, by contrast, is capable of achieving higher yields since the zeolite has a much higher selectivity for paraffin isomerization but under the moderate hydrogen pressures used in the process, the aromatics are not effectively dealt with in lower quality feeds and operation is constrained by the differing selectivity factors of the zeolite at different conversion levels.

SUMMARY OF THE INVENTION

We have now devised a process for producing high quality, high viscosity index (V.I.) lubricants by a two-stage wax hydrocracking-hydroisomerization process. The process is capable of producing products with very high viscosity indices, typically above about 140, usually in the range of 140 to 155 with values of 143 to 147 being typical. The process is capable of being operated with feeds of varying composition to produce high quality lube basestocks in good yield. Compared to the process using amorphous catalysts, yields are higher and the dewaxing requirement for the product is markedly lower due to the effectiveness of the process in converting the waxy paraffins, mainly linear and near linear paraffins, to less waxy isoparaffins of high viscosity index. Compared to the zeolite-catalyzed process, it has the advantage of being able to accommodate a wider range of feeds at constant product quality since it is more effective for the removal of the low quality aromatic components from the feed; it also provides a yield advantage in the range where maximum lube yield is obtained (about 20–30% conversion) as well as providing a higher product VI across a wide conversion range from about 5 to 40 percent conversion.

According to the present invention, the waxy feed is subjected to a two-stage hydrocracking-hydroisomerization. In the first stage, the feed is subjected to hydroprocessing over a bifunctional catalyst comprising a metal hydrogenation component on an amorphous acidic support under relatively mild conditions of limited conversion. The second stage comprises a hydroisomerization step which is carried out over a noble metal-containing zeolitic catalyst of low acidity. In the first stage, the low quality aromatic components of the feed are subjected to hydrocracking reactions which result in complete or partial saturation of aromatic rings accompanied by ring opening reactions to form products which are relatively more paraffinic; the limited conversion in the first stage, however, enables these products to be retained without undergoing further cracking to products boiling below the lube boiling range, typically below about 650° F. (about 345° C.). Typically, the conversion in the first stage is limited to no more than 30 weight percent of the original feed.

In the second stage, the conditions are optimized for hydroisomerization of the paraffins originally present in the feed together with the paraffins produced by hydrocracking in the first stage. For this purpose a low acidity catalyst with high isomerization selectivity is employed, and for this purpose, a low acidity zeolite beta catalyst has been found to give excellent results. A noble metal, preferably platinum, is used to provide hydrogenation-dehydrogenation functionality in this catalyst in order to promote the desired hydroisomerization reactions.

The process may be operated in two different modes, both of which require relatively high pressures in the first stage in order to maximize removal of aromatic components in the feed and for this purpose pressures of at least 800 psig (about 5620 kPa), usually from about 800 to 3,000 psig (about 5620 to 20785 kPa abs.) are suitable. The second stage may be operated either by cascading the first stage effluent directly into the second stage without a pressure reduction or, alternatively, since the second stage may be operated at relatively lower pressures, typically up to 1,000 psig (about 7,000 kPa abs.), by passing the first stage products through an interstage separator to remove light ends and inorganic heteroatoms. The cascade process without interstage separation, represents a preferred mode of operation because of its simplicity although the two-stage operation with the same or a reduced pressure in the second stage may be desirable if no high pressure vessel is available for this part of the operation. In both cases, however, the process is well suited for upgrading waxy feeds such as slack wax with aromatic contents greater than about 15 weight percent to high viscosity index lubricating oils with high single pass yields and a limited requirement for product dewaxing.

DRAWINGS

In the accompanying drawings, FIGS. 1 to 8 are graphs illustrating the results of wax hydroprocessing experiments reported in the Examples.

DETAILED DESCRIPTION

In the present process waxy feeds are converted to high V.I. lubricants in a two-stage hydrocracking-hydroisomerization process. The products are characterized by good viscometric properties including high viscosity index, typically at least 140 and usually in the range 143 to 147. The two stages of the process are carried out in the presence of hydrogen using catalysts which are optimized for selective removal of the low quality aromatic components in the first stage by hydrocracking reactions and selective paraffin isomerization in the second stage to form low pour point, high V.I. products.

Feed

The feed to the process comprises a petroleum wax which contains at least 50 weight percent wax, as determined by ASTM test D-3235. In these feeds of mineral oil origin, the waxes are mostly paraffins of high pour point, comprising straight chain and slightly branched chain paraffins such as methylparaffins.

Petroleum waxes, that is, waxes of paraffinic character are derived from the refining of petroleum and other liquids by physical separation from a wax-containing refinery stream, usually by chilling the stream to a temperature at which the wax separates, usually by solvent dewaxing, e.g., MEK/toluene dewaxing or by means of an autorefrigerant process such as propane dewaxing. These waxes have high initial boiling points above about 650° F. (about 345° C.) which render them extremely useful for processing into lubricants which also require an initial boiling point of at least 650° F. (about 345° C.). The presence of lower boiling components is not to be excluded since they will be removed together with products of similar boiling range produced during the processing during the separation steps which follow the characteristic processing steps. Since these components will, however, load up the process units they are preferably excluded by suitable choice of feed cut point. The end point of wax feeds derived from the solvent dewaxing of neutral oils i.e. distillate fractions produced by the vacuum distillation of long or atmospheric resids will usually be not more than about 1100° F. (about 595° C.) so that they may normally be classified as distillate rather than residual streams but high boiling wax feeds such as petrolatum waxes i.e. the waxes separated from bright stock dewaxing, which may typically have an end point of up to about 1300° F. (about 705° C.), may also be employed.

The wax content of the feed is high, generally at least 50, more usually at least 60 to 80, weight percent with the balance from occluded oil comprising iso-paraffins, aromatics and naphthenics. The non-wax content of aromatics, polynaphthenes and highly branched naphthenes will normally not exceed about 40 weight percent of the wax and preferably will not exceed 25 to 30 weight percent. These waxy, highly paraffinic wax stocks usually have low viscosities because of their relatively low content of aromatics and naphthenes although the high content of waxy paraffins gives them melting points and pour points which render them unacceptable as lubricants without further processing.

Feeds of this type will normally be slack waxes, that is, the waxy product obtained directly from a solvent dewaxing process, e.g. an MEK or propane dewaxing process. The slack wax, which is a solid to semi-solid product, comprising mostly highly waxy paraffins (mostly n- and monomethyl paraffins) together with occluded oil, may be fed directly to the first step of the present processing sequence as described below without the requirement for any initial preparation, for example, by hydrotreating.

The compositions of some typical waxes are given in Table 1 below.

TABLE 1

Wax Composition-Arab Light Crude

| | A | B | C | D |
|---|---|---|---|---|
| Paraffins, wt. pct. | 94.2 | 81.8 | 70.5 | 51.4 |
| Mono-naphthenes, wt. pct. | 2.6 | 11.0 | 6.3 | 16.5 |
| Poly-naphthenes, wt. pct. | 2.2 | 3.2 | 7.9 | 9.9 |
| Aromatics, wt. pct. | 1.0 | 4.0 | 15.3 | 22.2 |

A typical slack wax feed has the composition shown in Table 2 below. This slack wax is obtained from the solvent (MEK) dewaxing of a 300 SUS (65 cST) neutral oil obtained from an Arab Light crude.

TABLE 2

| Slack Wax Properties | | |
|---|---|---|
| API | 39 | |
| Hydrogen, wt. pct. | 15.14 | |
| Sulfur, wt. pct. | 0.18 | |
| Nitrogen, ppmw | 11 | |
| Melting point, ° C. (° F.) | 57(135) | |
| KV at 100° C., cSt | 5.168 | |
| PNA, wt pct: | | |
| Paraffins | 70.3 | |
| Naphthenes | 13.6 | |
| Aromatics | 16.3 | |
| Simulated Distillation: | | |
| % | ° C. | (° F.) |
| 5 | 375 | (710) |
| 10 | 413 | (775) |
| 30 | 440 | (825) |
| 50 | 460 | (860) |
| 70 | 482 | (900) |
| 90 | 500 | (932) |
| 95 | 507 | (945) |

Another slack wax suitable for use in the present process has the properties set out in Table 3 below. This wax is prepared by the solvent dewaxing of a 450 SUS (100 cS) neutral raffinate:

TABLE 3

| Slack Wax Properties | |
|---|---|
| Boiling range, ° F.(° C.) | 708–1053 (375–567) |
| API | 35.2 |
| Nitrogen, basic, ppmw | 23 |
| Nitrogen, total, ppmw | 28 |
| Sulfur, wt. pct | 0.115 |
| Hydrogen, wt. pct. | 14.04 |
| Pour point, ° F. (° C.) | 120(50) |
| KV (100° C.) | 7,025 |
| KV (300° F., 150° C.) | 3.227 |
| Oil(D 3235) | 35 |
| Molecular wt. | 539 |
| P/N/A: | |
| Paraffins | — |
| Naphthenes | — |
| Aromatics | 10 |

First Stage Hydroprocessing—Hydrocracking

The waxy feed is subjected to a two-step hydrocracking-hydroisomerization process in which both steps are normally carried out in the presence of hydrogen. In the first step, an amorphous bifunctional catalyst is used to promote the saturation and ring opening of the low quality aromatic components in the feed to produce hydrocracked products which are relatively more paraffinic. This stage is carried out under high pressure to favor aromatics saturation but the conversion is maintained at a relatively low level in order to minimize cracking of the paraffinic components of the feed and of the products obtained from the saturation and ring opening of the aromatic materials. Consistent with these process objectives, the hydrogen pressure in the first stage is at least 800 psig (about 5620 kPa abs.) and usually is in the range of 1,000 to 3,000 psig (about 7000 to 20785 kPa abs). Normally, hydrogen partial pressures of at least 1500 psig (about 1435 kPa abs.) are best in order to obtain a high level of aromatic saturation with pressures in the range of 1500 to 2500 psig (about 1435 to 17340 kPa abs) being suitable for most high pressure equipment. Hydrogen circulation rates of at least about 1000 SCF/Bbl (about 180 $n.l.l^{-1}$), preferably in the reange of 5,000 to 10,000 SCF/Bbl (about 900 to 1800 $n.l.l^{-1}$) are suitable.

In this stage of the process, the conversion of the feed to products boiling below the lube boiling range, typically to 650° F.– (about 345° C.–) products is limited to no more than 50 weight percent of the feed and will usually be not more than 30 weight percent of the feed in order to maintain the desired high single pass yields which are characteristic of the process while preparing, the feed for the second stage of the processing; an initial VI for the first stage product of at least about 130 is normally desirable for the final product to have the desired VI of 140 or higher. The actual conversion is, for this reason, dependant on the quality of the feed with slack wax feeds requiring a lower conversion than petrolatums where it is necessary to remove more low quality polycyclic components. With slack wax feeds derived from the dewaxing of neutral stocks, the conversion (650° F.+) will, for all practical purposes not be greater than 10 to 20 weight percent, with about 15 weight percent being typical for heavy neutral slack waxes. Higher conversions may be encountered with petrolatum feeds in order to prepare the feed for the second stage processing. With petrolatum feeds, the first stage conversion will typically be in the range of 20 to 25 weight percent for high VI products. The conversion may be maintained at the desired value by control of the temperature in this stage which will normally be in the range 600° to 800° F. (about 315° to 430° C.) and more usually in the range of about 650° to 750° F. (about 345° to 400° C.). Space velocity variation may also be used to control severity although this will be less common in practice in view of mechanical constraints on the system.

The exact temperature selected to achieve the desired conversion will depend on the characteristics of the feed and of the catalyst as well as upon the extent to which it is necessary to remove the low quality aromatic components from the feed. In general terms, higher severity conditions are required for processing the more aromatic feeds up to the usual maximum of about 30 percent aromatics, than with the more paraffinic feeds. Thus, the properties of the feed should be correlated with the activity of the selected catalyst in order to arrive at the required operating temperature for the first stage in order to achieve the desired product properties, with the objective at this stage being to remove the undesirable, low quality aromatic components by hydrocracking while minimizing conversion of the more desirable paraffinic components to products boiling below the lube boiling range. In order to achieve the desired severity in this stage, temperature may also be correlated with the space velocity although for practical reasons, the space velocity will normally be held at a fixed value in accordance with mechanical and other constraints such as minimizing pressure drop. Generally, the space velocity will be in the range of 0.25 to 2 LHSV, $hr.^{-1}$ and usually in the range of 0.5 to 1.5 LHSV.

A characteristic feature of the first stage operation is the use of a bifunctional lube hydrocracking catalyst. Catalysts of this type have a high selectivity for aromatics hydrocracking reactions in order to remove the low quality aromatic components from the feed. In general terms, these catalysts include a metal component for promoting the desired aromatics saturation reactions and usually a combination of base metals is used, with one metal from the iron group (Group VIII) in combination with a metal of Group VIB. Thus, the base metal such as nickel or cobalt is used in combination with molybdenum or tungsten. The preferred combination is nickel/tungsten since it has been found to be highly effective for promoting the desired aromatics hydrocracking reaction. Noble metals such as platinum or palladium may be used since they have good hydrogenation activity in the absence of sulfur but they will normally not be preferred. The amounts of the metals present on the catalyst are conventional for lube hydrocracking catalysts of this type and generally will range from 1 to 10 weight percent of the Group VIII metal and 10 to 30 weight percent of the Group VI metal, based on the total weight of the catalyst. If a noble metal component such as platinum or palladium is used instead of a base metal such as nickel or cobalt, relatively lower amounts are in order in view of the higher hydrogenation activities of these noble metals, typically from about 0.5 to 5 weight percent being sufficient. The metals may be incorporated by any suitable method including impregnation onto the porous support after it is formed into particles of the desired size or by addition to a gel of the support materials prior to calcination. Addition to the gel is a preferred technique when relatively high amounts of the metal components are to be added e.g. above 10 weight percent of the Group VIII metal and above 20 weight percent of the Group VI metal. These techniques are conventional in character and are employed for the production of lube hydrocracking catalysts.

The metal component of the catalyst is supported on a porous, amorphous metal oxide support and alumina is preferred for this purpose although silica-alumina may also be employed. Other metal oxide components may also be present in the support although their presence is less desirable. Consistent with the requirements of a lube hydrocracking catalyst, the support should have a pore size and distribution which is adequate to permit the relatively bulky components of the high boiling feeds to enter the interior pore structure of the catalyst where the desired hydrocracking reactions occur. To this extent, the catalyst will normally have a minimum pore size of about 50 Å i.e with no less than about 5 percent of the pores having a pore size less than 50 Å pore size, with the majority of the pores having a pore size in the range of 50–400 Å (no more than 5 percent having a pore size above 400 Å), preferably with no more than about 30 percent having pore sizes in the range of 200–400 Å. Preferred catalysts for the first stage have at least 60 percent of the pores in the 50–200 Å range. The pore size distribution and other properties of some typical lube hydrocracking catalysts suitable for use in the first stage are shown in Table 4 below:

TABLE 4

LHDC Catalyst Properties

| Form | 1.5 mm cyl. | 1.5 mm. tri. | 1.5 mm. cyl. |
|---|---|---|---|
| Pore Volume, cc/gm | 0.331 | 0.453 | 0.426 |
| Surface Area, $m^2$/gm | 131 | 170 | 116 |
| Nickel, wt. pct. | 4.8 | 4.6 | 5.6 |
| Tungsten, wt. pct. | 22.3 | 23.8 | 17.25 |
| Fluorine, wt. pct. | — | — | 3.35 |
| Silica, wt. pct. | — | — | 2 |
| Alumina, wt. pct. | — | — | 60.3 |
| Real Density, gm/cc | 4.229 | 4.238 | 4.023 |
| Particle Density, gm/cc | 1.744 | 1.451 | 1.483 |
| Packing Density, gm/cc | 1.2 | 0.85 | 0.94 |

If necessary in order to obtain the desired conversion, the catalyst may be promoted with fluorine, either by incorporating fluorine into the catalyst during its preparation or by operating the hydrocracking in the presence of a fluorine compound which is added to the feed. This will normally not be required with the processing of slack wax feeds but petrolatum feeds requiring higher levels of conversion, as discussed above, may necessitate the use of a halogenated catalyst as well as the use of higher temperatures during the hydrocracking. Fluorine compounds may be incorporated into the catalyst by impregnation during its preparation with a suitable fluorine compound such as ammonium fluoride ($NH_4F$) or ammonium bifluoride ($NH_4F.HF$) of which the latter is preferred. The amount of fluorine used in catalysts which contain this element is preferably from about 1 to 10 weight percent, based on the total weight of the catalyst, usually from about 2 to 6 weight percent. The fluorine may be incorporated by adding the fluorine compound to a gel of the metal oxide support during the preparation of the catalyst or by impregnation after the particles of the catalyst have been formed by drying or calcining the gel. If the catalyst contains a relatively high amount of fluorine as well as high amounts of the metals, as noted above, it is preferred to incorporate the metals and the fluorine compound into the metal oxide gel prior to drying and calcining the gel to form the finished catalyst particles.

The catalyst activity may also be maintained at the desired level by in situ fluoriding in which a fluorine compound is added to the stream which passes over the catalyst in this stage of the operation. The fluorine compound may be added continuously or intermittently to the feed or, alternatively, an initial activation step may be carried out in which the fluorine compound is passed over the catalyst in the absence of the feed e.g. in a stream of hydrogen in order to increase the fluorine content of the catalyst prior to initiation of the actual hydrocracking. In situ fluoriding of the catalyst in this way is preferably carried out to induce a fluorine content of about 1 to 10 percent fluorine prior to operation, after which the fluorine can be reduced to maintenance levels sufficient to maintain the desired activity. Suitable compounds for in situ fluoriding are orthofluorotoluene and difluoroethane.

The metals present on the catalyst are preferably used in their sulfide form and to this purpose pre-sulfiding of the catalyst should be carried out prior to initiation of the hydrocracking. Sulfiding is an established technique and it is typically carried out by contacting the catalyst with a sulfur-containing gas, usually in the presence of hydrogen. The mixture of hydrogen and hydrogen sulfide, carbon disulfide or a mercaptan such as butol mercaptan is conventional for this purpose. Presulfiding may also be carried out by contacting the catalyst with hydrogen and a sulfur-containing hydrocarbon oil such as a sour kerosene or gas oil.

Because the feeds are highly paraffinic, the heteroatom content is low and accordingly the feed may be passed directly into the first process step, without the necessity of a preliminary hydrotreatment.

Hydroisomerization

During the first stage of the process, the low quality, relatively aromatic components of the feed are converted by hydrocracking to products which are relatively more paraffinic in character by saturation and ring opening. The paraffinic materials present in the stream at this stage of the process possess good VI characteristics but have relatively high pour points as a result of their paraffinic nature. The objective in the second stage of the process is to effect a selective hydroisomerization of these paraffinic components to iso-paraffins which, while possessing good viscometric properties, also have lower pour points. This enables the pour point of the final product to be obtained without an excessive degree of dewaxing following the hydroisomerization. Because the low quality aromatic components have been removed by the initial hydrocracking step, there is no requirement for achieving any significant degree of aromatic saturation in the second stage of the operation so that it is possible to carry it out under relatively low pressures, typically in the range of about 200 to 1000 psig (about 1480 to 7000 kPa) although pressures from about 400 to 1000 psig (about 2860 to 7000 kPa) are more typical. In the low pressure mode of operation, it is preferred to operate the second stage with hydrogen partial pressures from at least 200 psig (about 1480 kPa).

Another mode of operation is with higher hydrogen pressures in the second stage, typically over 1000 psig (about 7000 kPa). This mode of operation is preferred since the second stage can be operated in cascade with the first stage, at an inlet pressure equal to the outlet pressure of the first stage.

In the preferred modes of operation, therefore, the second stage will operate at a hydrogen partial pressure of 400 to 1000 psig (2860 to 7000 kPa) in the low pressure mode or at hydrogen partial pressures of 1000 to 3000 psig, usually 1500–2500 psig (1435 to 17340 kPa) in the high pressure mode. Hydrogen circulation rates are comparable to those used in the first stage.

The catalyst used in the second stage is one which has a high selectivity for the isomerization of waxy, linear or near linear paraffins to less waxy, isoparaffinic products. Catalysts of this type are bifunctional in character, comprising a metal component on a large pore size, porous support of relatively low acidity. The acidity is maintained at a low level in order to reduce conversion to products boiling outside the lube boiling range during this stage of the operation. In general terms, an alpha value below 20 (see FIG. 8) should be employed, with preferred values below 10, best results being obtained with alpha values below 5 and good results being achieved at alpha values of 1 to 2.

The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 $sec^{-1}$). The alpha test is described in U.S. Pat. No. 3,354,078 and in *J. Catalysis,* 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in *J. Catalysis,* 61, 395 (1980). For the bifunctional catalysts used in this stage of the present process, the alpha value is determined in the absence of the metal component.

The support material for the paraffin hydroisomerization catalyst is zeolite beta, a highly siliceous, zeolite in a form which has the required low level of acid activity to minimize paraffin cracking and to maximize paraffin isomerization. Low acidity values in the zeolite may be obtained by use of a sufficiently high silica:alumina ratio in the zeolite, achievable either by direct synthesis of the zeolite with the appropriate composition or by steaming or dealuminization procedures such as acid extraction. Isomorphous substitution of metals other than aluminum may also be utilized to produce a zeolite with a low inherent acidity. Alternatively, the zeolite may be subjected to alkali metal cation exchange to the desired low acidity level, although this is less preferred than the use of a zeolite which contains framework elements other than aluminum.

Zeolite beta is the preferred support since this zeolite has been shown to possess outstanding activity for paraffin isomerization in the presence of aromatics, as disclosed in U.S. Pat. No. 4,419,220. The low acidity forms of zeolite beta may be obtained by synthesis of a highly siliceous form of the zeolite e.g with a silica-alumina ratio above about 50:1 or, more readily, by steaming zeolites of lower silica-alumina ratio to the requisite acidity level. Another method is by replacement of a portion of the framework aluminum of the zeolite with another trivalent element such as boron which results in a lower intrinsic level of acid activity in the zeolite. The preferred zeolites of this type are those which contain framework boron and normally, at least 0.1 weight percent, preferably at least 0.5 weight percent, of framework boron is preferred in the zeolite. In zeolites of this type, the framework consists principally of silicon tetrahedrally coordinated and interconnected with oxygen bridges. The minor amount of an element (alumina in the case of aluminosilicate zeolite beta) is also coordinated and forms part of the framework. The zeolite also contains material in the pores of the structure although these do not form part of the framework constituting the characteristic structure of the zeolite. The term "framework" boron is used here to distinguish between material in the framework of the zeolite which is evidenced by contributing ion exchange capacity to the zeolite, from material which is present in the pores and which has no effect on the total ion exchange capacity of the zeolite.

Methods for preparing high silica content zeolites containing framework boron are known and are described, for example, in U.S. Pat. Nos. 4,269,813; a method for preparing zeolite beta containing framework boron is disclosed in U.S. Pat. No. 4,672,049. As noted there, the amount of boron contained in the zeolite may be varied by incorporating different amounts of borate ion in the zeolite forming solution e.g. by the use of varying amounts of boric acid relative to the forces of silica and alumina. Reference is made to these disclosures for a description of the methods by which these zeolites may be made.

In the present low acidity zeolite beta catalyst, the zeolite should contain at least 0.1 weight percent framework boron, preferably at least 0.5 weight percent boron. Normally, the maximum amount of boron will be about 5 weight percent of the zeolite and in most cases not more than 2 weight percent of the zeolite. The framework will normally include some alumina and the silica:alumina ratio will usually be at least 30:1, in the as-synthesized conditions of the zeolite. A preferred zeolite beta catalyst is made by steaming an initial boron-containing zeolite containing at least 1 weight percent boron (as $B_2O_3$) to result in an ultimate alpha value no greater than 10 and preferably no greater than 5.

The steaming conditions should be adjusted in order to attain the desired alpha value in the final catalyst and typically utilize atmospheres of 100 percent steam, at temperatures of from about 800° to about 1100° F. (about 427° to 595° C.). Normally, the steaming will be carried out for about 12 to 48 hours, typically about 24 hours, in order to obtain the desired reduction in acidity. The use of steaming to reduce the acid activity of the zeolite has been found to be especially advantageous, giving results which are not achieved by the use of a zeolite which has the same acidity in its as-synthesized condition. It is believed that these results may be attributable to the presence of trivalent metals removed from the framework during the steaming operation which enhance the functioning of the zeolite in a manner which is not fully understood.

The zeolite will be composited with a matrix material to form the finished catalyst and for this purpose conventional non-acidic matrix materials such as alumina, silica-alumina and silica are suitable with preference given to silica as a non-acidic binder, although non-acidic aluminas such as alpha boehmite (alpha alumina monohydrate) may also be used, provided that they do not confer any substantial degree of acidic activity on the matrixed catalyst. The use of silica as a binder is preferred since alumina, even if non-acidic in character, may tend to react with the zeolite under hydrothermal reaction conditions to enhance its acidity. The zeolite is usually composited with the matrix in amounts from 80:20 to 20:80 by weight, typically from 80:20 to 50:50 zeolite:matrix. Compositing may be done by conventional means including mulling the materials together followed by extrusion of pelletizing into the desired finished catalyst particles. A preferred method for extruding the zeolite with silica as a binder is disclosed in U.S. Pat. No. 4,582,815. If the catalyst is to be steamed in order to achieve the desired low acidity, it is performed after the catalyst has been formulated with the binder, as is conventional.

The second stage catalyst also includes a metal component in order to promote the desired hydroisomerization reactions which, proceeding through unsaturated transitional species, require mediation by a hydrogenation-dehydrogenation component. In order to maximize the isomerization activity of the catalyst, metals having a strong hydrogenation function are preferred and for this reason, platinum and the other noble metals such as palladium are given a preference. The amount of the noble metal hydrogenation component is typically in the range 0.5 to 5 weight percent of the total catalyst, usually from 0.5 to 2 weight percent. The platinum may be incorporated into the catalyst by conventional techniques including ion exchange with complex platinum cations such as platinum tetraammine or by impregnation with solutions of soluble platinum compounds, for example, with platinum tetraammine salts such as platinum tetraamminechloride. The catalyst may be subjected to a final calcination under conventional conditions in order to convert the noble metal to the oxide form and to confer the required mechanical strength on the catalyst. Prior to use the catalyst may be subjected to presulfiding as described above for the first stage catalyst.

The objective in the second stage is to isomerize the waxy, linear and near-linear paraffinic components in the first stage effluent to less waxy but high VI isoparaffinic materials of relatively lower pour point. The conditions in the second stage are therefore adjusted to achieve this end while minimizing conversion to non-lube boiling range products (usually 650° F.– (345° C.–) materials). Since the catalyst used in this stage has a low acidity, conversion to lower boiling products is usually at a relatively low level and by appropriate selection of severity, second stage operation may be optimized for isomerization over cracking. At conventional space velocities of about 1, using a Pt/zeolite beta catalyst with an alpha value below 5, temperatures in the second stage will typically be in the range of about 550° to about 700° F. (about 290° to 370° C.) with 650° F.+ conversion typically about 10 to 30 weight percent, more usually 12 to 20 weight percent, of the second stage feed. However, temperatures may be used outside this range, for example, as low as about 500° F. (260° C.) up to about 750° F. (about 400° C.) although the higher temperatures will usually not be preferred since they will be associated with a lower isomerization selectivity and the production of less stable lube products as a result of the hydrogenation reactions being thermodynamically less favored at progressively higher operating temperatures. With the increased activity resulting from the use of high hydrogen pressures in the high pressure mode, temperatures in the second stage may be somewhat lower than those appropriate to low pressure operation; in the high pressure mode, temperatures of 550° to 700° F. (about 290° to 370° C.) will be preferred, as compared to the preferred range of 600° to 700° F. (about 315° to 370° C.) for this stage of the operation in the low pressure mode. Space velocities will typically be in the range of 0.5 to 2 LHSV (hr.$^{-1}$) although in most cases a space velocity of about 1 LHSV will be most favorable. Hydrogen circulation rates are comparable to those use in the first step, as described above but since there is no significant hydrogen consumption as a result of near hydrogen balance in this second step of the process, lower circulation rates may be employed if feasible. In the cascade operational mode, the excess hydrogen from the first stage will be found adequate for the second stage operation.

A particular advantage of the present process is that it enables a functional separation to be effected in the entire operating scheme. In the first stage, the undesirable low VI components are removed by a process of saturation and ring opening under conditions of high pressure and relatively high temperature. By contrast, the second stage is intended to maximize the content of iso-paraffins in the product and because the low VI materials have been dealt with in the first stage, can be optimized to effect a selective isomerization of the paraffinic materials. The low temperature conditions which are appropriate for the paraffin isomerization limit the cracking reactions as noted above but are thermodynamically favorable for the saturation of any lube range olefins which may be formed by cracking reactions, particularly in the presence of the highly active hydrogenation components on the catalyst. In this way, the second stage is also effective for hydrofinishing the product so that product stability is improved, especially stability to ultraviolet radiation, a property which is frequently lacking in conventional hydrocracked lube products. The hydrofinishing is particularly effective when the second step is carried out under high hydrogen partial pressures e.g. over about 1000 psig (about 7000 kPa). The isomerized product may therefore be subjected simply to a final dewaxing step in order to achieve the desired target pour point and usually there will be no need for any further finishing steps since a low unsaturates content, both of aromatics and of lube range olefins, results from the optimized processing in the two functionally separated steps of the process. The product may therefore be subjected to a final fractionation to remove lower boiling materials, followed by a final dewaxing step in order to achieve target pour point for the product.

Dewaxing

Although a final dewaxing step will normally be necessary in order to achieve the desired product pour point, it is a notable feature of the present process that the extent of dewaxing required is relatively small. Typically, the loss during the final dewaxing step will be no more than 15 to 20 weight percent of the dewaxer feed and may be lower. Either catalytic dewaxing or solvent dewaxing may be used at this point and if a solvent dewaxer is used, the removed wax may be recycled to the first or second stages of the process for further treatment. Since the wax removed in a solvent dewaxer is highly paraffinic, it may be recycled directly to the second stage if this is feasible, for example, in the embodiment where the second stage is operated at a relatively low pressure.

The preferred catalytic dewaxing processes utilize an intermediate pore size zeolite such as ZSM-5, but the most preferred dewaxing catalysts are based on the highly constrained intermediate pore size zeolites such as ZSM-22, ZSM-23 or ZSM-35, since these zeolites have been found to provide highly selective dewaxing, giving dewaxed products of low pour point and high VI. Dewaxing processes using these zeolites are described in U.S. Pat. Nos. 4,222,855. The zeolites whose use is preferred here may be characterized in the same way as described in U.S. Pat. No. 4,222,855, i.e. as zeolites having pore openings which result in the the possession of defined sorption properties set out in the patent, namely, (1) a ratio of sorption of n-hexane to o-xylene, on a volume percent basis, of greater than about 3, which sorption is determined at a $P/P_O$ of 0.1 and at a temperature of 50° C. for n-hexane and 80° C. for o-xylene and (2) by the ability of selectively cracking 3-methylpentane (3MP) in preference to the doubly branched 2,3-dimethylbutane (DMB) at 1000° F. and 1 atmosphere pressure from a 1/1/1 weight ratio mixture of n-hexane/3-methyl-pentane/2,3-dimethylbutane, with the ratio of rate constants $k_{3MP}/k_{DMB}$ determined at a temperature of 1000° F. being in excess of about 2. The expression, "$P/P_O$", is accorded its usual significance as described in the literature, for example, in "The Dynamical Character of Adsorption" by J. H. deBoer, 2nd Edition, Oxford University Press (1968) and is the relative pressure defined as the ratio of the partial pressure of sorbate to the vapor pressure of sorbate at the temperature of sorption. The ratio of the rate constants, $k_{3MP}/k_{DMB}$, is determined from 1st order kinetics, in the usual manner, by the following equation:

$$k=(1/T_c)\ln(1/1-\square)$$

where k is the rate constant for each component, $T_c$ is the contact time and □ is the fractional conversion of each component.

Zeolites conforming to these sorption requirements include the naturally occurring zeolite ferrierite as well as the known synthetic zeolites ZSM-22, ZSM-23 and ZSM-35. These zeolites are at least partly in the acid or hydrogen form when they are used in the dewaxing process and a metal hydrogenation component, preferably a noble metal such as platinum is preferable used. Excellent results have been obtained with a Pt/ZSM-23 dewaxing catalyst.

The preparation and properties of zeolites ZSM-22, ZSM-23 and ZSM-35 are described respectively in U.S. Pat. Nos. 4,810,357 (ZSM-22); 4,076,842 and 4,104,151 (ZSM-23) and 4,016,245 (ZSM-35), to which reference is made for a description of this zeolite and its preparation. Ferrierite is a naturally-occurring mineral, described in the literature, see, e.g., D. W. Breck, ZEOLITE MOLECULAR SIEVES, John Wiley and Sons (1974), pages 125–127, 146, 219 and 625, to which reference is made for a description of this zeolite.

In any event, however, the demands on the dewaxing unit for the product are relatively low and in this respect the present process provides a significant improvement over the process employing solely amorphous catalysts where a significant degree of dewaxing is required. The functional separation inherent in the process enable higher single pass wax conversions to be achieved, typically about 70 to 80% as compared to 50% for the amorphous catalyst process so that unit throughput is significantly enhanced with respect to the conventional process. Although conversions levels above 80 percent may be employed so that the load on the dewaxer is reduced, the product VI and yield decrease at the same time and generally, the final dewaxing stage cannot be completely eliminated unless products with a VI below about 135 are accepted.

Products

The products from the process are high VI, low pour point materials which are obtained in excellent yield. Besides having excellent viscometric properties they are also highly stable, both oxidatively and thermally and to ultraviolet light. VI values in the range of 140 to 155 are typically obtained, with values of 143 to 147 being readily achievable with product yields of at least 50 weight percent, usually at least 60 weight percent, based on the original wax feed, corresponding to wax conversion values of almost 80 and 90 percent, respectively. Another notable feature of the process is that the products retain desirable viscosity values as a result of the limited boiling range conversions which are inherent in the process: conversely, higher yields are obtained at constant product viscosity.

EXAMPLES

The following examples are given in order to illustrate various aspects of the present process. Examples 1 and 2, directly following, illustrate the preparation of low acidity Pt/zeolite beta catalysts containing framework boron.

Example 1

A boron-containing zeolite beta catalyst was prepared by crystallizing the following mixture at 285° F. (140° C.) for 13 days, with stirring:

| | |
|---|---|
| Boric acid, g. | 57.6 |
| NaOH, 50%, ml. | 66.0 |
| TEABr, ml. | 384 |
| Seeds, g. | 37.0 |
| Silica, g. | 332 |
| Water, g. | 1020 |

Notes:
1. TEABR = Tetraethylemmoniium bromide, as 50% aqueous solution.
2. Silica = Ultrasil (trademark).

The calcined product had the following analysis and was confirmed to have the structure of zeolite beta by X-ray diffraction:

| | |
|---|---|
| $SiO_2$ | 76.2 |
| $Al_2O_3$ | 0.3 |
| B | 1.08 |
| Na, ppm | 1070 |
| N | 1.65 |
| Ash | 81.6 |

Example 2

The as-synthesized boron-containing zeolite beta of Example 1 was mulled and extruded with silica in a zeolite:silica weight ratio of 65:35, dried and calcined at 900° F. (480° C.) for 3 hours in nitrogen, followed by 1000° F. (540° C.) in air for three hours. The resulting extrudate was exchanged with 1N ammonium nitrate solution at room temperature for 1 hour after which the exchanged catalyst was calcined in air at 1000° F. (540° C.) for 3 hours, followed by 24 hours in 100 percent steam at 1025° F. (550° C.). The steamed extrudate was found to contain 0.48 weight percent boron (as $B_2O_3$), 365 ppm sodium and 1920 ppm $Al_2O_3$. The steamed catalyst was then exchanged for 4 hours at room temperature with 1N platinum tetraammine chloride solution with a final calcination at 660° F. (350° C.) for three hours. The finished catalyst contained 0.87 weight percent platinum and had an alpha value of 4.

Example 3

A slack wax with the properties shown in Table 3 above and containing 30 wt % oil based on bulk solvent dewaxing (35 wt % oil by ASTM D3235) was processed by hydrocracking over a 1.5 mm trilobe NiW/fluorided alumina catalyst of the type described in Table 4 above (4.8 wt. pct. Ni, 22.3 wt. pct. W). The catalyst was sulfided and fluorided in-situ using o-fluorotoluene at a level of 600 ppm fluorine for one week at a temperature of 725° F. (385° C.) before introducing the slack wax. The hydrocracking was carried out with fluorine maintenance at 25 ppm F using o-fluorotoluene under the following conditions:

| | |
|---|---|
| LHSV, $hr^{-1}$ | 1 |
| Pressure, psig (kPa abs) | 2000 (13890) |
| H2 circulation, SCF/BBL ($n.L.L.^{-1}$) | 7500 (1335) |

The reaction severity was adjusted by varying the reaction temperature from 704° to 770° F. which resulted in wax conversions of 40 to 95 weight percent. Wax conversion is defined as follows:

$$\text{Wax Conversion} = \frac{(\text{Wax in Oil Feed} - \text{Wax obtained by Solvent Dewaxing})}{\text{Wax in Oil Feed}}$$

A mildly hydrocracked sample obtained at a reactor temperature of 704° F.(373° C.), was distilled to remove the 650° F.− (345° C.−) material (14 weight percent) in the sample to produce a product whose properties are given in Table 5 below. This hydrocracked product was used for subsequent processing as described in Example 5 below.

TABLE 5

Hydrocracked (704° F., 373° C,) Slack Wax Properties

| | |
|---|---|
| Boiling range, ° F. (° C.) | 656–1022 (347–550) |
| API | — |
| Nitrogen, ppmw | 6 |
| Sulfur, wt. pct. | .001 |
| Pour Point, ° F. (° C.) | 120(49) |
| KV, 100° C., cS | 5.68 |
| KV, 300° F. (150° C.), cS | 2.748 |
| Molecular wt. | 478 |
| Aromatics, Wt. pct. | 2 |

Comparison of the properties of the hydrocracked slack wax as shown in Table 5 with the properties of the original slack wax, as shown in Table 3, shows that there has been a significant decrease in the aromatic content accompanied by a mild decrease in molecular weight and viscosity although pour point has not changed at all.

FIG. 1 shows the lube yield relative to wax conversion, with the results from the two-stage LHDC/HDI experiments of Example 5 included for comparison. The figure shows that the lube yield for the single stage LHDC process of Example 3 reaches a maximum value of about 46 percent at about 40–60 percent wax conversion.

Example 4

This Example illustrates a single step wax hydroisomerization process (no initial hydrocracking) using a low acidity hydroisomerization catalyst.

A low acidity silica-bound zeolite beta catalyst prepared by the method described in Example 2 above was charged to a reactor in the form of 30/60 mesh (Tyler) particles and then sulfided using 2% $H_2S$/98% $H_2$ by incrementally increasing the reactor temperature up to 750° F. (400° C.) at 50 psig (445 Kpa abs). The same slack wax that was mildly hydrocracked in Example 3 was charged directly to the catalyst without first stage hydrocracking. The reaction conditions were 400 psig(2860 kPa abs), 2500 SCF $H_2$/Bbl (445 $n.l.l^{-1}$), and 0.5 LHSV. The results are given in Table 7 below.

Example 5

A two-step cascade lube hydrocracking/hydroisomerization (LHDC/HDI) process was carried out by the following procedure.

The low acidity Pt/zeolite beta catalyst of Example 2 was charged to the reactor and pre-sulfided as described in Example 4. The hydrocracked distillate 650° F.+ (345° C.+) fraction from Example 3 was then processed over this catalyst at temperatures from 622° to 667° F. (328° to 353° C.), 0.5 LHSV, 400 psig (2860 Kpa abs) and 2500 SCF $H_2$/Bbl (445 $n.l.l^{-1}$). The bottoms fraction was distilled to produce 650° F.+ (345° C.+) material which was subsequently dewaxed using MEK/toluene.

The properties of the dewaxed product are given in Table 6 below.

TABLE 6

Isomerization of Low Conversion Hydrocracked Slack Wax

| | Feed | | | | | |
|---|---|---|---|---|---|---|
| Run No. | — | 5-1 | 5-2 | 5-3 | 5-4 | 5-5 |
| Temp, ° F. | — | 667 | 648 | 635 | 637 | 622 |
| 650° F.+ Conv, wt % | — | 28.7 | 18.8 | 12.4 | 14.5 | 10.3 |
| 650° F.+ Pour, ° F. | — | 42 | 64 | 80 | 75 | 91 |
| SDWO Properties | | | | | | |
| KV @ 40° C., cSt | 28.84 | 22.289 | 23.11 | 23.804 | 22.585 | 24.486 |
| KV @ 100° C., cSt | 5.711 | 4.794 | 4.974 | 5.075 | 4.890 | 5.164 |
| VI | 143 | 141 | 147 | 147 | 146 | 147 |
| Pour Point, ° F. | 15 | 20 | 10 | 15 | 10 | 10 |
| VI @ 0° F. Pour | 140 | 137 | 145 | 144 | 144 | 145 |
| Lube Yield, wt % | | 55.6 | 61.5 | 61.2 | 60.2 | 57.4 |
| Wax Conversion | | 92 | 88 | 79 | 81 | 71 |
| Selectivity | | 40 | 51 | 56 | 54 | 55 |

The lube yield of the two-step LHDC/HDI sequence relative to wax conversion is shown in FIG. 1 with the yield of the single step LHDC process given for comparison. The figure shows that the two-step processing achieves a higher lube yield of about 61 percent at about 88 percent wax conversion, both these values being significantly higher than achieved by the single step LHDC process. Process optimization is therefore achieved by the functional separation of the processing steps.

The yield data in FIG. 1 also show that the high wax conversion selectivity (ratio of isomerate formed/wax converted) can be maintained at very high wax conversions (up to 90 weight percent) whereas the mild hydrocracking scheme (Example 3) cannot maintain high wax conversion selectivities above 40–50 weight percent wax conversion due to excessive overcracking at the higher conversion levels.

Figure 2:
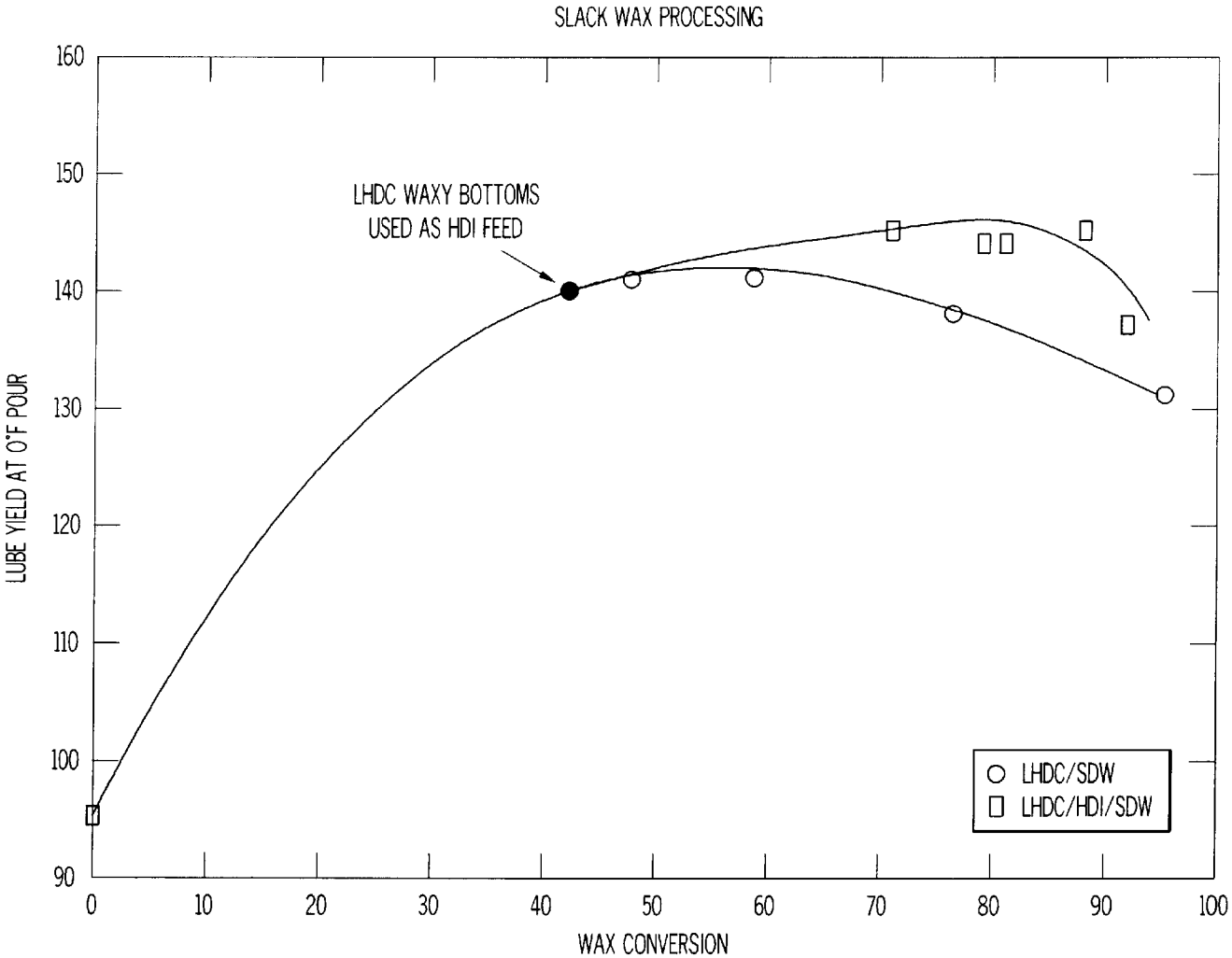
Figure 3:
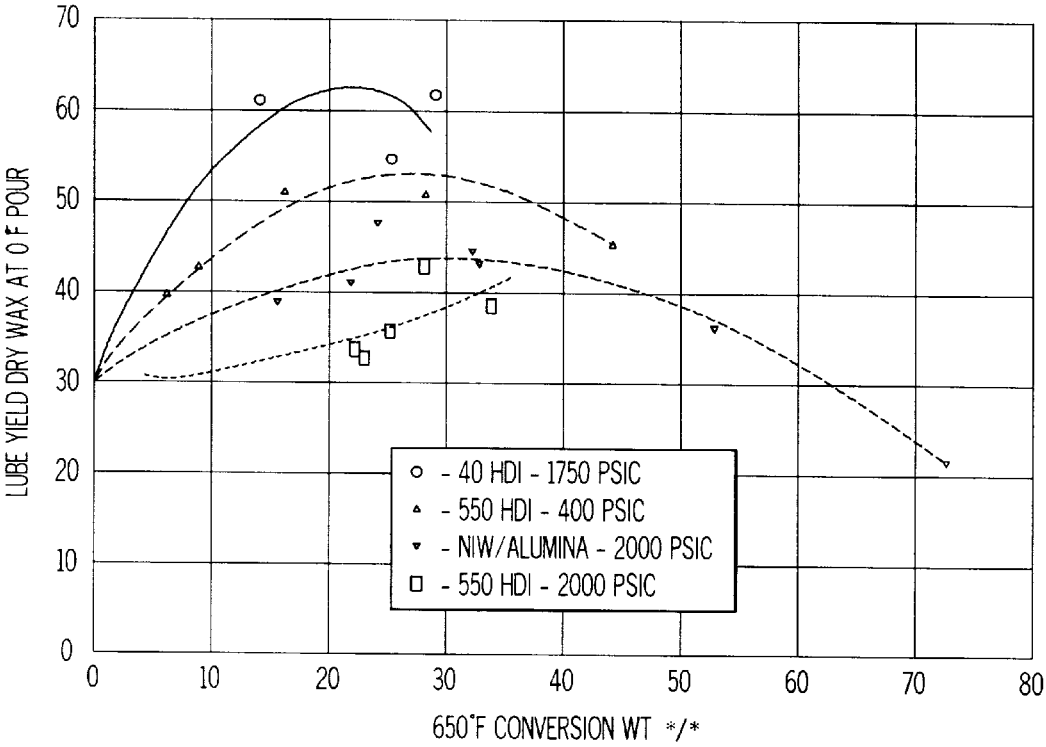
Figure 4:
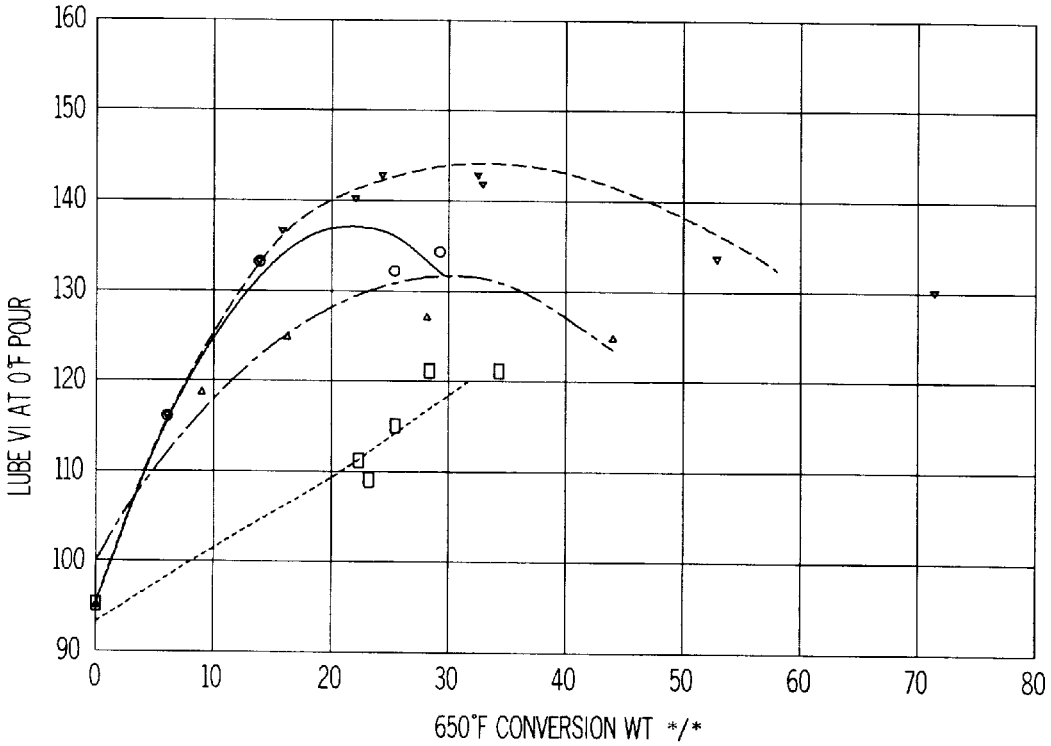
Figure 5:
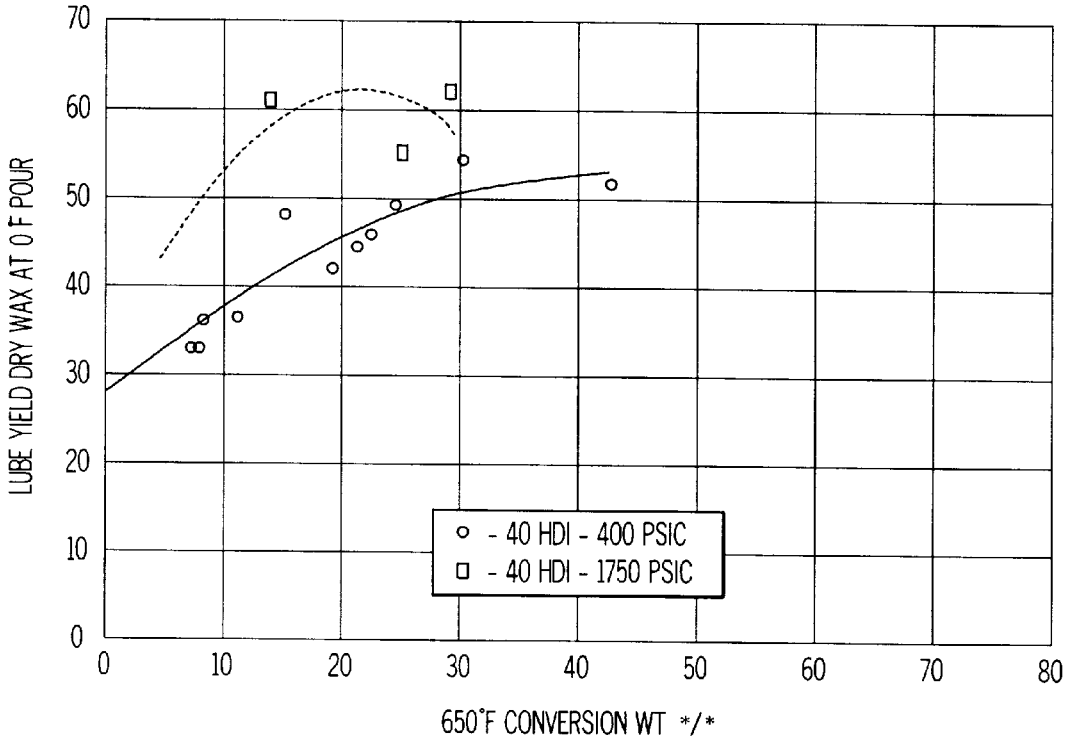
Figure 6:
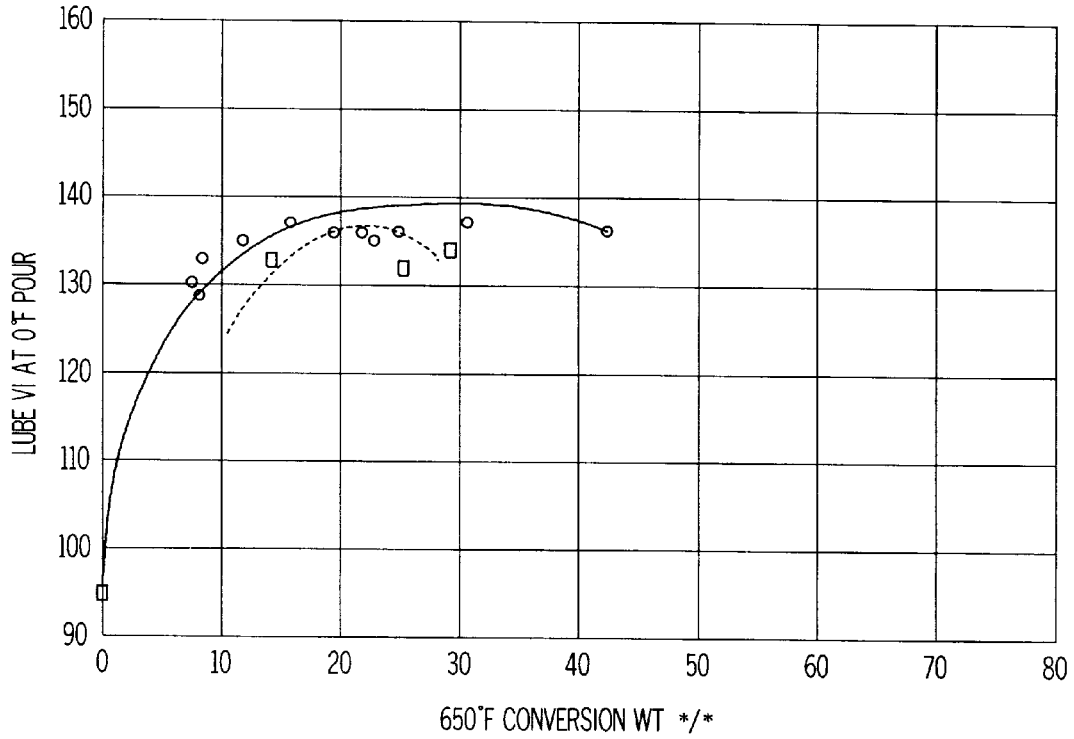

FIG. 2 shows that, along with the lube yield, there is an improvement in the viscosity index (VI) of the product obtained from the combined LHDC/HDI scheme of Example 5 of about three numbers over the product of the mild hydrocracking of Example 3. The improved wax isomerization selectivity of the combined scheme therefore allows both higher lube yield and higher VI products even at high wax conversion levels.

Example 6

A two-step lube hydrocracking/hydroisomerization process was carried out using the slack wax feed of Table 3 above and the catalysts of Example 3 (hydrocracking) and Example 2 (Pt/zeolite beta). The process was operated in direct cascade at a pressure of 2000 psig (13890 kPa) in each stage, at a temperature of 715° F.(380° C.) for the hydrocracking and 645° F. (340° C.0 for the hydroisomerization. The space velocity was 1.0 $hr^{-1}$ in each stage. The Pt/beta hydroisomerization catalyst used in the second stage was presulfided in the same way as described in Example 4. the results are given in Table 7 below.

Table 7 compares the maximum lube yields, product VIs, and reactor temperature requirements for all four slack wax processing schemes: (i) mild hydrocracking (Example 3), (ii) wax isomerization using a low acidity HDI catalyst (Pt/B-beta) (Example 4), (iii) the combined LHDC/HDI scheme of mild hydrocracking over an amorphous HDC catalyst followed by low pressure wax hydroisomerization over a low acidity Pt/B-beta catalyst (Example 5) and (iv) cascade LHDC/HDI over an amorphous HDC catalyst followed by high pressure wax hydroisomerization over a low acidity Pt/B-beta catalyst (Example 6)

TABLE 7

Comparison of Catalyst Activities and Product Properties from Slack Wax Processing Schemes.

| Example No. | 3 | 4 | 5 | 6 |
|---|---|---|---|---|
| Process Scheme | HDC | HDI | HDC/HDI (Hi/Lo) | HDC/HDI (Hi/Hi) |
| Reactor Temp., ° F. | 725 | 785 | 704/648 | 715/645 |
| LHSV, $hr^{-1}$ | 1.0 | 0.5 | 1.0/0.5 | 1.0/1.0 |
| Pressure, psig | 2000 | 400 | 2000/400 | 2000/2000 |
| Lube Yield, wt % | 46 | 53–55 | 61 | 61 |
| Solvent Dewaxed Oil Properties: | | | | |
| VI @ 0° F. pour pt. | 141 | 135–137 | 145 | 143 |
| KV @ 100° C., cS | 4.8 | 5.8–5.9 | 5.0 | 4.9 |

Note
Lube yield determined at constant cut point

Table 7 shows that the combined mild hydrocracking, hydroisomerization processes of Examples 5 and 6 have a significant activity advantage (about 130° F., 54° C.) over the single stage paraffin hydroisomerization process of Example 4 using the same hydroisomerization catalyst (Pt/B-beta), at comparable product viscosity. Moreover, the combined processes also produce a higher VI product in higher yield than either the single stage high pressure hydrocracking process or the low pressure isomerization process. Thus, the integrated process scheme using either low or high pressure hydroisomerization is superior to either of the individual processes.

Example 7

This Example compares the use of a low and high pressure wax hydroisomerizations. This Example, in conjunction with Example 8 also shows that a low acidity second stage catalyst (x<15) is preferred over a higher acidity catalyst.

The catalyst of Example 2 was charged to a downflow reactor and sulfided as described in Example 4. The slack wax of Example 3 was then fed with hydrogen to the reactor in cocurrent downflow under the following conditions:

| | |
|---|---|
| LHSV, $hr^{-1}$ | 0.5 |
| $H_2$ Flow Rate, SCF/Bbl(n.1.1.$^{-1}$) | 2500(445) |
| Total Pressure, psig (kPa abs.) | 400 and 1750(2860 and 2170) |

Example 8

A zeolite beta sample with a bulk $SiO_2/Al_2O_3$ ratio of 40:1 was extruded with alumina to form a 65/35 weight percent cylindrical extrudate. This material was then dried, calcined and steamed to reduce the alpha to 55. Platinum was incorporated by means of ion exchange using $Pt(NH_3)_4Cl_2$. The final Pt loading was 0.6 weight percent. This catalyst was then charged to the reactor and sulfided as described above. Hydrogen was fed to the reactor together with the same slack wax described in Example 3 in cocurrent downflow under the following conditions:

| | |
|---|---|
| LHSV, $hr^{-1}$ | 1.0 |
| $H_2$ Flow Rate,SCF/Bbl (n.1.1.$^{-1}$) | 2000(356) |
| Total Pressure, psig(kpa abs) | 400 and 2000(2860 and 13890) |

Table 8 below compares the maximum lube yields and VI of the products at maximum yield from the runs described in Examples 3, 7 and 8.

TABLE 8

| Example No. | 3 | 7 | | 8 | |
|---|---|---|---|---|---|
| Catalyst | NiW/ alumina | 4α Pt/beta | | 55α Pt/beta | |
| Pressure, psig | 2000 | 400 | 1750 | 400 | 2000 |
| Lube yield, wt. pct | 46 | 55–58 | 61 | 51 | 41 |
| KV, 100° F., cS | 5.0 | 5.8 | 6.0 | 5.8 | 7.0 |
| Lube VI | 142 | 135–137 | 133–134 | 127 | 121 |

The results summarized in Table 8 show that slack wax can be processed over a low acidity catalyst such as Pt/zeolite beta at high pressure without the yield or VI penalties incurred with a comparable but more acidic catalyst.

FIGS. 3 to 6 compare the yield and VI data as a function of conversion of the slack wax for the processes of Examples 3, 4, 7 and 8. Conversion here is defined as the net amount of feed converted to 650° F.– (345° C.–). These results show that the low acidity Pt/zeolite beta catalyst of Example 2 (4□) produces the highest yield for processing the raw slack wax, as shown by Example 4: the 4□ Pt/zeolite beta catalyst produces as much as 15 percent more lube than the amorphous $NiW/Al_2O_3$ catalyst used in Example 3 and 10 to 20% more lube than the higher acidity 55□ Pt/zeolite beta catalyst of Example 8. Increasing the operating pressure of the hydroisomerization results in a significant yield loss in the case of the higher acidity Pt/zeolite beta catalyst of Example 8, but results in a yield increase for the low acidity Pt/zeolite beta catalyst used in Example 7.

Product VI is not as strongly affected by pressure with the low acidity Pt/zeolite beta as it is with the higher acidity Pt/zeolite beta catalyst.

Figure 7:
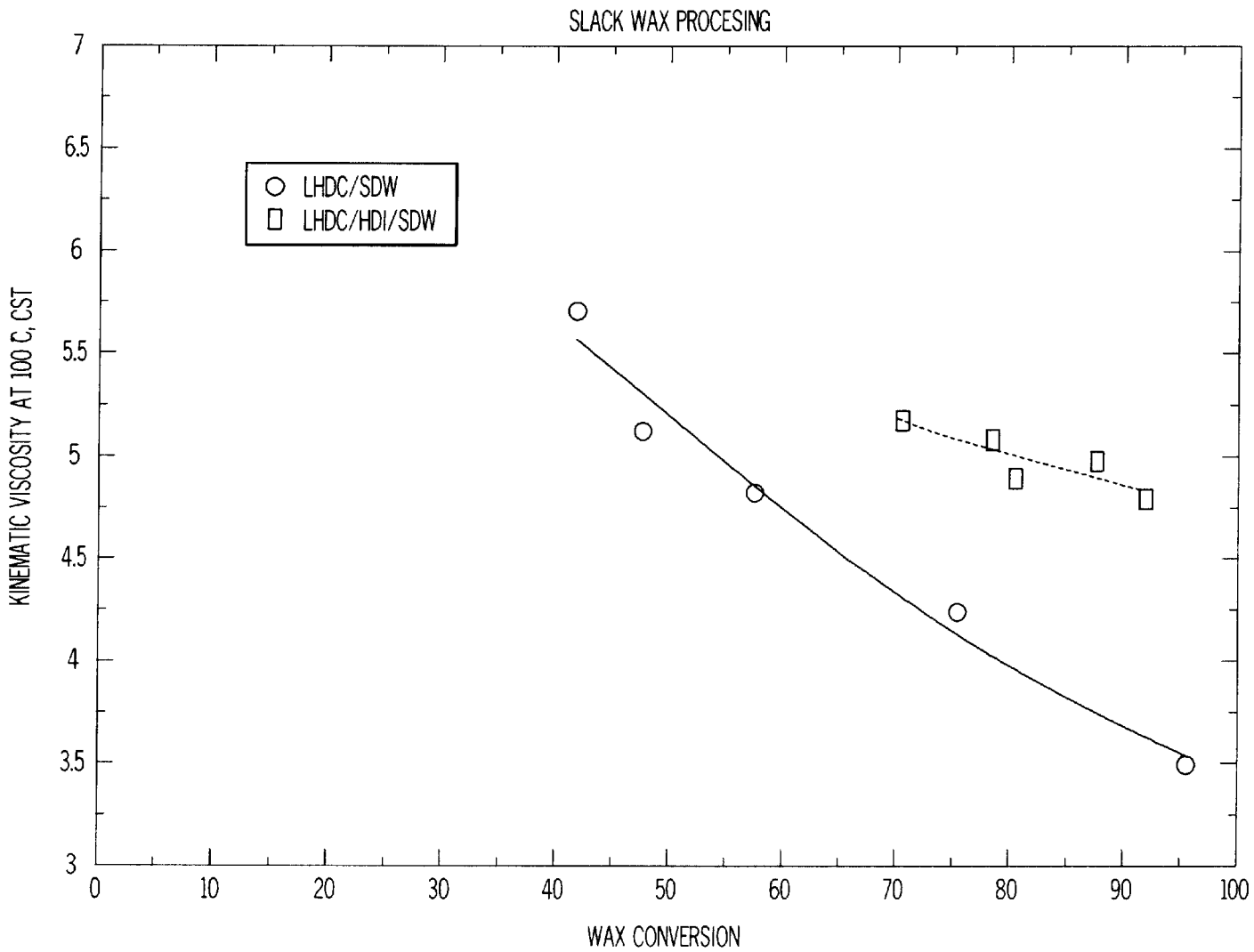

FIG. 7 shows the relationship between the kinematic viscosity (at 100° C.) of the product at varying wax conversions for the LHDC/HDI/SDW sequence of the present invention as well as for a conventional LHDC/SDW sequence using the same slack wax feed taken to a constant product cut point of 650° F. (about 345° C.). The figure shows that the present process enables viscosity to be retained to a greater degree than with the conventional processing technique as a result of the selective conversion of wax to high VI oil without excessive conversion of oil out of the lube boiling range. This valuable feature enables products of varying viscosities to be manufactured by suitable selection of conditions.

Example 9

A petrolatum wax having the properties set out in Table 9 below was subjected to cascade hydrocracking/hydroisomerization under the conditions set out in Table 10, to produce an 8 cSt. (nominal) lube oil. The lube yields and properties are reported for a constant viscosity cut of 7.8 cSt., at approximately 650° F. (345° C.) cut point.

TABLE 9

| Petrolatum Wax Properties | |
|---|---|
| Boiling range, nominal (SIMDIS), ° F. | 780°–1300° |
| N, ppmw | 120 |
| S, wt. pct. | 0.3 |
| Oil Content, ASTMD-3235, wt. pct. | 25 |
| API° | 31 |

Example 10

Figure 8:
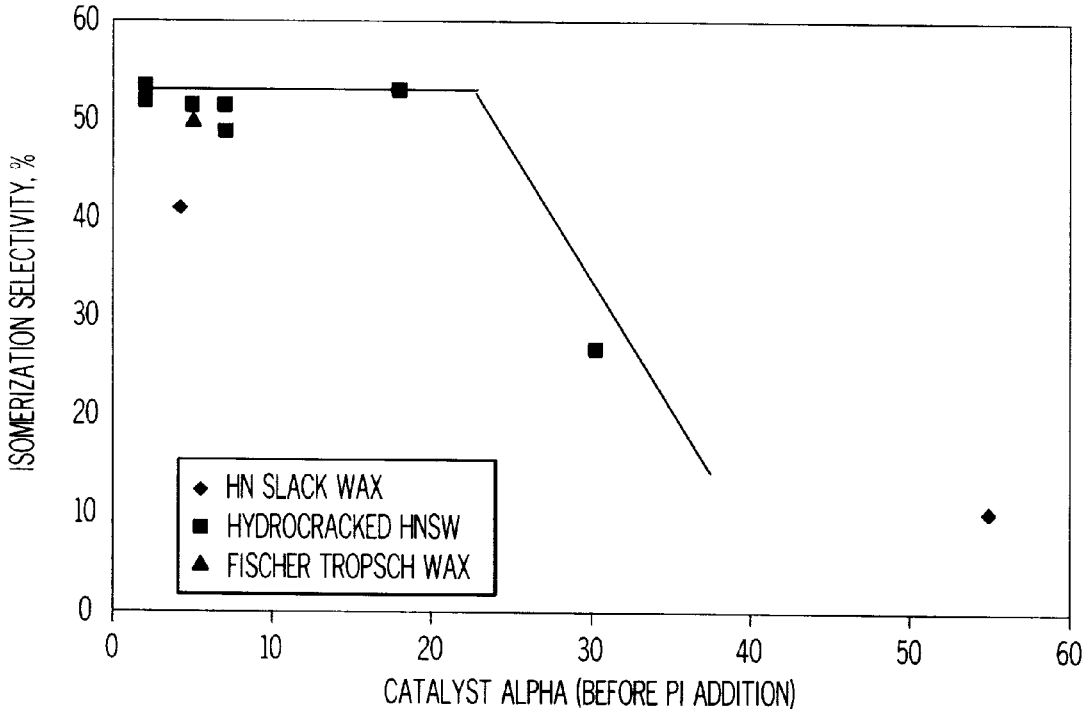

FIG. 8 illustrates the impact of the alpha value on the isomerization selectivity of zeolite beta loaded with platinum. Alpha values were determined prior to platinum addition. The feed in most cases was Hydrocracked Heavy Neutral Slack Wax. One example using Fisher-Torch wax is given. The typical properties of slack wax are found in Table 2. Isomerization selectivity was plotted against catalyst alpha. Alpha values no greater than twenty consistently demonstrated an isomerization selectivity in the range from about 48 to about 53%. When alpha values increased beyond 20, the relationship between isomerization selectivity and alpha values became inversely proportional.

TABLE 10

| Petrolatum HDC/HDI Conditions | |
|---|---|
| Pressure, $H_2$, psig (kpa) | 2000/2000 (13890/13890) |
| LHSV, hr. $^{-1}$ | 1.0/1.0 |
| Temp, °F. (° C.) | 745/674 (396/357) |
| Lube, at 7.8 cSt. | |
| Yield, wt. pct. | 45 |
| KV, cSt at 100° C. | 7.8 |
| VI | 144 |

The product is produced in good yield and has excellent viscometric properties, as shown by Table 10.

We claim:

1. A process for producing a high viscosity index lubricant having a viscosity index of at least 140 from a petroleum wax feed having a wax content of at least 50 wt % and an aromatic content of from 5 to 20 wt %, wherein the wax of the feed comprises predominantly straight chain and methyl paraffins, which process comprises:

(a) hydrocracking the wax feed at a hydrogen partial pressure of at least 800 psig over a bifunctional lube hydrocracking catalyst comprising a metal hydrogenation component, wherein the component comprises at least one Group VIII metal and at least one Group VI metal on an acidic, amorphous, porous support material to hydrocrack aromatic components present in the feed in the presence of the wax components of the wax feed at a severity which results in a conversion of not more than 50 wt % of the feed to products boiling outside the lube boiling range to produce a hydrocracked effluent;

(b) isomerizing waxy paraffins present in the effluent from the hydrocracking step (a) in the presence of a low acidity isomerization catalyst having an alpha value of not more than 20 and an isomerization selectivity of no less than 48%, and comprising a noble metal hydrogenation component on a porous support material comprising zeolite beta to isomerize waxy paraffins to less waxy isoparaffins of lower pour point so as to increase the content of isoparaffins in the stream and produce as effluent a lubricant product having a viscosity index of at least 140 and to achieve (i) a higher yield of the lubricant product of viscosity index at least 140, at constant product pour point, relative to the hydrocracking alone at constant wax conversion and (ii) a lighter lubricant product viscosity index of at least 140, at constant product pour point, relative to the hydrocracking alone at constant wax conversion.

2. A process according to claim 1, in which the viscosity index of the effluent of step (a) is greater than or equal to 130.

3. A process according to claim 1, in which the effluent from the hydrocracking step (a) is cascaded directly to the isomerization step (b).

4. A process according to claim 1, in which the conversion of the wax components of the wax feed of step (a) may be from 40 to 95 wt. %, where wax conversion is defined as [(wax in oil feed–wax obtained by solvent dewaxing product)/(wax in oil feed].

5. A process according to claim 1 in which the petroleum wax feed to step (a) comprises a slack wax having an aromatic content of from 8 to 12 wt. %.

6. A process according to claim 1 in which the hydrocracking catalyst of step (a) comprises alumina as an acidic support material.

7. A process according to claim 1 in which the lube hydrocracking catalyst of step (a) is a fluorided lube hydrocracking catalyst which has been pre-fluorided to a fluorine content of 1 to 10 wt. % fluorine.

8. A process according to claim 1 in which the conversion during the hydrocracking step (a) to 650° F.– material is from 10 to 30 wt % of the feed.

9. A process according to claim 1 in which the isomerized product of step (b) is subjected to dewaxing to achieve a target pour point,with a loss during the dewaxing of not more than 20 wt %.

10. A process for producing a high viscosity index lubricant having a viscosity index of at least 140 from a petroleum wax feed having a wax content of at least 50 wt % and an aromatic content of from 5 to 20 wt %, wherein the wax of the feed comprises predominantly straight chain and methyl paraffins, which process comprises:

(a) hydrocracking the wax feed at a hydrogen partial pressure of at least 800 psig over a bifunctional lube hydrocracking catalyst comprising a metal hydrogenation component, wherein the component comprises at least one Group VIII metal and at least one Group VI metal on an acidic, amorphous, porous support material to hydrocrack aromatic components present in the feed in the presence of the wax components of the wax feed at a severity which results in a conversion of not more than 50 wt % of the feed to products boiling outside the lube boiling range to produce a hydrocracked effluent, which is cascaded directly to the isomerization step(b);

(b) isomerizing waxy paraffins present in the effluent from the hydrocracking step(a) in the presence of a low acidity isomerization catalyst having an alpha value of not more than 20 and an isomerization selectivity of no less than 48%, and comprising a noble metal hydrogenation component on a porous support material comprising zeolite beta to isomerize waxy paraffins to less waxy isoparaffins of lower pour point so as to increase the content of isoparaffins in the stream and produce as effluent a lubricant product having a viscosity index of at least 140 and to achieve (i) a higher yield of the lubricant product of viscosity index at least 140, at constant product pour point, relative to the hydrocracking alone at constant wax conversion and (ii) a lighter lubricant product viscosity index of at least 140, at constant product pour point, relative to the hydrocracking alone at constant wax conversion.

11. A process according to claim 10, in which the viscosity index of the effluent of step (a) is greater than or equal to 130.

12. A process according to claim 10, in which the conversion of the wax components of the wax feed of step (a) may be from 40 to 95 wt. %, where wax conversion is defined as [(wax in oil feed–wax obtained by solvent dewaxing product)/(wax in oil feed)].

13. A process for producing a high viscosity index lubricant having a viscosity index of at least 140 from a petroleum wax feed having a wax content of at least 50 wt % and an aromatic content of from 5 to 20 wt %, wherein the wax of the feed comprises predominantly straight chain and methyl paraffins, which process comprises:

(a) hydrocracking the wax feed at a hydrogen partial pressure of at least 1000 psig over a bifunctional lube hydrocracking catalyst comprising a metal hydrogenation component, wherein the component comprises at least one Group VIII metal and at least one Group VI metal on an acidic, amorphous, porous support material at a temperature of at least 650° F. to hydrocrack aromatic components present in the feed in the presence of the wax components of the wax feed at a severity which results in a conversion of not more than 50 wt % of the feed to products boiling outside the lube boiling range to produce a hydrocracked effluent;

(b) hydroisomerizing waxy paraffins present in the effluent from the hydrocracking step at a hydrogen partial pressure from 200 to 1000 psig at a temperature from 600° F. to 700° F. in the presence of a low acidity isomerization catalyst having an alpha value of not more than 20 and an isomerizaiton selectiveity of no less than 48%, and comprising a noble metal hydrogenation component on a porous support material comprising zeolite beta to isomerize waxy paraffins to less waxy isoparaffins of lower pour point so as to increase the content of isoparaffins in the stream and produce as effluent a lubricant product having a viscosity index of at least 140 and to achieve (i) a higher yield of the lubricant product of viscosity index at least 140, at constant product pour point, relative to the hydrocracking alone at constant wax conversion and (ii) a lighter lubricant product viscosity index of at least 140, at constant product pour point, relative to the hydrocracking alone at constant wax conversion.

14. The process of claim 13, in which the hydrocracking step (a) is carried out at a hydrogen partial pressure of 1500 to 2500 psig.

* * * * *